US005952161A

United States Patent [19]

Earle

[11] Patent Number: 5,952,161

[45] Date of Patent: Sep. 14, 1999

[54] PROCESSING PHOTOGRAPHIC MATERIAL

[75] Inventor: Anthony Earle, Harrow Weald, United Kingdom

[73] Assignee: Eastman Kodak Company, Rochester, N.Y.

[21] Appl. No.: 09/167,425

[22] Filed: Oct. 6, 1998

[30] Foreign Application Priority Data

Oct. 9, 1997 [GB] United Kingdom ..... 9721467

[51] Int. Cl.[6] ..... G03C 11/00

[52] U.S. Cl. ..... 430/421; 396/626; 396/630

[58] Field of Search ..... 430/421; 396/626, 396/630

[56] References Cited

U.S. PATENT DOCUMENTS

| | | | |
|---|---|---|---|
| 5,272,499 | 12/1993 | Yamada | 396/626 |
| 5,510,870 | 4/1996 | Kashino et al. | 396/626 |
| 5,541,700 | 7/1996 | Earle et al. | 396/630 |
| 5,689,751 | 11/1997 | Ueda | 396/630 |
| 5,797,059 | 8/1998 | Yoshizawa et al. | 396/626 |
| 5,822,643 | 10/1998 | Rosenburgh et al. | 396/626 |

*Primary Examiner*—Hoa Van Le
*Attorney, Agent, or Firm*—Frank Pincelli

[57] ABSTRACT

An exposed photographic film is processed by being passed from a first tank into a second tank containing processing solution through an air bubble. The solution is supplied to the second tank and is arranged to flow into the first tank, such that the film is processed in a counter-current mode.

6 Claims, 1 Drawing Sheet

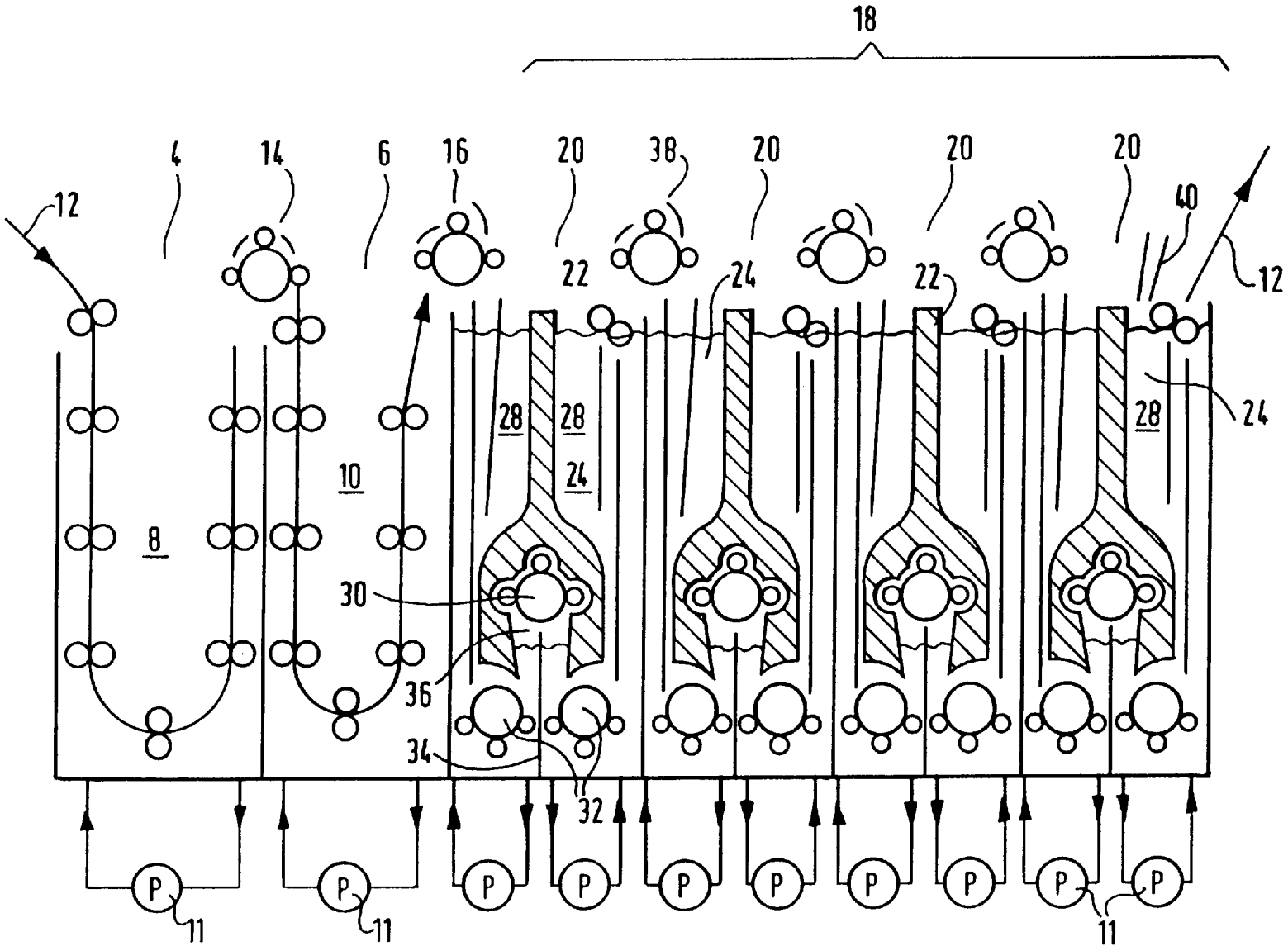
18
12
40
20
24
28
22
38
16
6
14
4
10
8
30
36
34
32
11
P

PROCESSING PHOTOGRAPHIC MATERIAL

FIELD OF THE INVENTION

This invention relates to the processing, and particularly but not exclusively the washing or stabilizing, of photographic material, usually already exposed, in which the material passes through a plurality of stages.

BACKGROUND OF THE INVENTION

Photographic material as referred to herein is understood to be generally planar, may comprise film or paper, may produce a black-and-white or color image, and may be in a continuous web form or may comprise discrete sheets.

Silver halide photographic materials are well-known, and are processed to generate a silver or dye image via a development stage followed by a series of baths to stabilize and provide permanence to the image. Such baths convert and remove unwanted materials from the coated photographic layers which would either interfere with the quality of the final image or cause degradation of the image with time. In typical color systems the development stage is followed by a bleach stage to oxidize the developed silver to a form which can be dissolved by a fixing agent in the same or a separate bath. Such silver removal stages are then followed by a washing stage using water, or other wash solution, or a stabilization stage using a stabilizer solution. For convenience, this last-mentioned stage will hereinafter be referred to generically as "washing." Such stages remove residual chemicals and may also include conversion reactions between stabilizer solution components and materials within the coated layers. These stages are required to provide the required degree of permanence to the final image.

In many cases, particularly in small-scale "minilab"0 or "microlab" equipment, the wash stage is performed in a multi-tank arrangement. Usually the replenishment of this stage, which keeps the concentration of substances removed from the photographic material at a constant and sufficiently low level, is carried out by adding fresh wash solution to the final tank of the sequence and arranging over-flow from the final tank to flow into the previous tank and so on, the overflow from the first tank of this stage being then discarded as effluent. This is referred to as a "counter-current" mode. This arrangement allows significantly lower amounts of solution to be used compared with one or two tanks especially when these are replenished separately.

In a modern minilab a typical wash replenishment system might use around 200 $cm^3$ of replenisher per $m^2$ of sensitized material processed in a three- or four-tank counter-current arrangement. The time the processed material spends in each tank is typically 20 to 25 seconds during which time an equilibrium is established between the concentration of substances in the coated material and the seasoned (steady-state) concentrations in the wash solution. The total time for this stage typically varies from 60 to over 100 seconds.

U.S. Pat. No. 5,541,700 discloses photographic processing apparatus in which two processing tanks are provided in a single container that is divided into two by an air bubble at a dividing wall. Different processing solutions can then be introduced into each tank and maintained separate by the bubble whilst allowing the photographic material being processed to pass from one tank to the other through the bubble over the wall. This allows the number of containers to be reduced.

In a typical conventional photographic processor, there are two tanks dedicated to the developer and bleach/fix stages and at least two tanks dedicated to wash the active chemicals out of the material. In order to reduce the quantity of wash solution, and thus to reduce the amount of effluent, it is known to increase the number of tanks and to arrange the solution to flow in the counter direction to the movement of the photographic material. However, this leads to a physically larger processing machine and also to an increase in total processing time, each of which is disadvantageous.

SUMMARY OF THE INVENTION

It is an object of the present invention to provide improved photographic processing in which the apparatus may occupy reduced floor space and in which the processing time and effluent are minimized.

In accordance with one aspect of the present invention, there is provided a method of processing photographic material in which the material is passed from processing solution, for example a wash solution, contained in a first tank through a fluid bubble into processing solution contained in an adjacent, second tank disposed on the other side of dividing means, and in which processing solution is arranged to flow from the second tank into the first tank past the dividing means.

The material may be passed from the second tank through a fluid bubble into a third tank disposed on the other side of further dividing means, and processing solution in the third tank may then be arranged to flow therefrom into the second tank past the further dividing means.

The fluid bubble may be formed as a gas bubble, preferably of air, but in any event will be of a substance that will maintain its integrity when subjected to the processing solution.

The dividing means may comprise a wall.

The processing solution may simply be allowed to flow over from a tank into the preceding tank, or it may be pumped.

The processing solution may be a wash solution for washing the photographic material.

In accordance with another aspect of the present invention, there is provided apparatus for processing photographic material, comprising a container that has at least four successive regions for containing processing solution, wherein the regions are separated by walls each of which has guide means and a chamber associated therewith, whereby the photographic material is guided from one processing region to the next through gas, preferably air, that is trapped by the solution in the chamber.

The processing solution in each region may be effective to carry out the same processing, preferably washing, of the material. Alternatively, the processing solution in at least one region may be arranged to carry out processing of the material that is different from that carried out in at least one other region.

In accordance with a further aspect of the present invention, there is provided apparatus for processing photographic material comprising a container for receiving processing solution through which the material is arranged to pass, wherein the container comprises means for guiding the material in a sinuous path such that the material reverses its vertical direction of movement (3+4 n) times, where n is a positive integer, with the reversals taking place alternately in the solution and in gas, preferably air, that is trapped in chambers of the container by the solution.

Alternate chambers may be located at the top and at the bottom of the container.

The apparatus may comprise means arranged to cause the processing solution to flow therethrough in a direction counter to the direction of movement of the material.

The provision of chambers of gas sealed from the atmosphere reduce the surface area of the processing solution that is exposed, and thus reduces the amount of oxidation of the solution.

The invention takes advantage of counter-current flow to reduce significantly the quantity of processing solution that is used, and thus wasted, and does so by employing the concept of a bubble in a way that is quite contrary to the usage taught in U.S. Pat. No. 5,541,700. That is to say, U.S. Pat. No. 5,541,700 specifically teaches the use of a bubble constantly to maintain separation of different solutions in adjacent tanks, whereas in the present invention, the bubble is used to maintain the processing solution separate in adjacent tanks to the extent of defining two processing stages whilst at the same time arranging for processing solution to overcome the barrier means in counter-current flow and to pass from one tank to another.

The components for providing the adjacent tanks can be such that, for example, two wash stages in accordance with the present invention will fit into a conventional tank for a single wash stage. This may be done by retro-fitting of existing equipment. Thus, the space presently provided for washing can be occupied by double the number of wash stages, or alternatively, the space allocated for washing can be reduced. Alternatively, original apparatus may be manufactured in accordance with the invention, so that the tanks may be of any desired size.

BRIEF DESCRIPTION OF THE DRAWINGS

Photographic processing apparatus and method, each in accordance with the present invention, will now be described, by way of example, with reference to the accompanying drawing, which is a schematic sectional elevation of one embodiment of a film processor.

DETAILED DESCRIPTION OF THE INVENTION

Referring to the drawing, a film processor 2 comprises conventional deep tanks 4 and 6 containing developer solution 8 and bleach/fix solution 10, respectively, the solutions being agitated by means of recirculation pumps 11 and replenished in conventional manner (not shown). An exposed film 12 to be processed is guided between rollers in a U-shaped path through the developer tank 4, and then, via a roller/guide assembly 14, similarly through the bleach/fix tank 6. Subsequently, the film 12 passes via a roller/guide assembly 16 into a wash section 18 of the processor 2.

The wash section 18 has four identical containers 20 that are the same size as each of the tanks 4, 6, and each of which contains an identical air bell arrangement 22 immersed in wash solution 24. Reference will thus be made in detail only to one of the containers 20. The air bell arrangement 22 has a wall 26 that divides the container 20 into two equi-sized tanks 28. The wall 26 is bifurcated at its lower end and contains a roller/guide assembly 30 between its forks and roller/guide assemblies 32 beyond the ends thereof. A dividing wall 34 extends upwardly from the bottom of the container 20 into the region between the forks of the wall 26. The wash solution 24 is poured into the tanks 28 so as substantially to fill the container 20 around the air bell arrangement 22 and to trap a bubble of air 36 around the roller assembly 30 in the bifurcated region of the wall 26 and above the container wall 34.

In operation, the film 12 is guided down into the solution 24 in the first tank 28 of the first wash container 20 around the outside of the air bell arrangement 22, through the first roller assembly 32, up into the air bubble 36, and around the roller assembly 30. From there, the film 12 travels into the adjacent second tank 28 down around the second roller assembly 32 and up out of the solution 24 to a further roller/guide assembly 38 to be transferred into the next dual wash tank 28 in the adjacent container 20. This process is repeated as the film is transported through the further four tanks 28 of the last two containers 20 until the film 12 finally leaves the washing region 18 for transfer to a drying section (not shown).

After the initial filling of the containers 20, replenishment of the wash solution 24 during operation of the processor 2 is carried out by supplying fresh solution through an inlet pipe 40 to the final tank 28. This changes the liquid level in the air bell 36 of the final container 20, setting up a counter-current flow of the wash solution 24 from the final, eighth tank 28 into the seventh tank 28 over the container divider wall 34. The counter-current flow carries on over the top of the final, fourth container 20 into the sixth tank 28 in the third container 20, through its air bubble 36, and so on until the increased level in the first wash tank 28 of the first container 20 adjacent the bleach-fix tank 6 is removed through a drain outlet (not shown). As an alternative to counter-current flow over the top from one container 20 to a previous one, the wash solution 24 may be transferred by pumping. Recirculation pumps 11 are also fitted to each wash tank 28 to effect agitation of the solution at the bottom thereof. It will be appreciated that as processing of the film 12 takes place, and in particular as it proceeds through the eight wash tanks 28, the concentration of the wash solution 24 will vary from one tank to another as the active chemicals are transferred from the film 12 to the solution 24.

As shown in the drawing, each container 20, being of the size of a conventional wash tank, now contains two wash tanks. It is envisaged that one or more of the containers 20 may, by suitable modification of the shape of the air bell arrangement 22, contain three, or more, tanks, employing two, or more, air bubbles.

It is to be understood that various other changes and modifications may be made without departing from the scope of the present invention, the present invention being limited by the following claims.

PARTS LIST

2 film processor
4 developer tank
6 bleach/fix tank
8 developer solution
10 bleach/fix solution
11 recirculation pumps
12 exposed film
14 roller/guide assembly
16 roller/guide assembly
18 wash section
20 containers
22 air bell arrangement
24 wash solution
26 wall
28 equi-sized tanks
30 roller/guide assembly
32 roller/guide assemblies
34 dividing wall
36 bubble of air

38 roller/guide assembly
40 inlet pipe

What is claimed is:

1. A method of processing photographic material wherein the material is passed from processing solution contained in a first tank through a fluid bubble into processing solution contained in an adjacent, second tank disposed on the other side of dividing means, and wherein processing solution is arranged to flow from the second tank into the first tank past the dividing means.

2. A method according to claim 1, wherein the material is passed from the second tank through a fluid bubble into a third tank disposed on the other side of further dividing means, and wherein processing solution in the third tank is arranged to flow therefrom into the second tank past the further dividing means.

3. A method according to claim 1, wherein the fluid bubble is formed as a gas bubble, preferably of air.

4. A method according to claim 1, wherein the dividing means comprises a wall.

5. A method according to claim 1, wherein the processing solution is allowed to flow over from a tank into the preceding tank.

6. A method according to claim 1, wherein the processing solution is pumped from a tank into the preceding tank.

* * * * *